US008234896B2

(12) United States Patent
Uliano

(10) Patent No.: US 8,234,896 B2
(45) Date of Patent: Aug. 7, 2012

(54) PADLOCK FOR ADJUSTING TO A LENGTH OF A LOCK CYLINDER

(76) Inventor: George Uliano, Orlando, FL (US)

( * ) Notice: Subject to any disclaimer, the term of this patent is extended or adjusted under 35 U.S.C. 154(b) by 347 days.

(21) Appl. No.: 12/606,144

(22) Filed: Oct. 26, 2009

(65) Prior Publication Data

US 2011/0094273 A1 Apr. 28, 2011

(51) Int. Cl.
*E05B 9/04* (2006.01)

(52) U.S. Cl. ..... 70/371; 70/38 A; 70/372; 70/374; 70/379 R; 70/386

(58) Field of Classification Search ..... 70/38 A, 70/38 R, 370–374, 379 R, 379 A, 386
See application file for complete search history.

(56) References Cited

U.S. PATENT DOCUMENTS 4,063,435 A 12/1977 Oliver
4,099,397 A * 7/1978 Dauenbaugh ..... 70/371
4,290,279 A 9/1981 Fish et al.
4,545,223 A * 10/1985 Poutiainen et al. ..... 70/38 A
4,766,187 A 8/1988 Beckley et al.
4,836,001 A 6/1989 Foshee
5,121,619 A * 6/1992 Martin ..... 70/371
5,127,244 A 7/1992 Myers
5,345,794 A 9/1994 Jenks
5,921,123 A 7/1999 Schwarzkopf et al.
6,145,356 A * 11/2000 Thwing ..... 70/389
6,338,261 B1 1/2002 Liu
6,393,876 B1 5/2002 Matyko
6,453,706 B1 9/2002 Chen
6,766,671 B2 7/2004 Haczynski et al.
7,278,283 B2 10/2007 Meckbach
7,472,568 B2 1/2009 Tang

* cited by examiner

*Primary Examiner* — Suzanne Barrett
(74) *Attorney, Agent, or Firm* — Ariel S. Bentolila; Bay Area IP Group, LLC

(57) ABSTRACT

A padlock for adjusting to a length of a lock cylinder includes a padlock housing and a shackle having an unlocked position and a locked position within the padlock housing. A central bore is disposed in a bottom of the padlock housing having a depth longer than the length of the lock cylinder for accepting the lock cylinder within the padlock housing. An adaptable cam is adjustably joinable to a distal end of the lock cylinder for adjusting for a difference between the depth and the length, and for rotatable engagement of the shackle to enable the shackle to move between the locked position and the unlocked position. A lock cap is joinable to an open end of the central bore for retaining the adaptable cam and the lock cylinder within the central bore.

20 Claims, 5 Drawing Sheets

PADLOCK FOR ADJUSTING TO A LENGTH OF A LOCK CYLINDER

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

The present invention relates generally to locks. More particularly, the invention relates to a padlock in which the lock cylinder may be changed.

BACKGROUND OF THE INVENTION

The present invention provides an improvement over standard padlocks by enabling an end user to change the padlock lock cylinder easily. Many current padlocks use lock cylinders that are incorporated into the padlock and cannot be changed by the end user. Therefore, a lock is sold at a particular security level, and this security level cannot be changed, for example, without limitation, "upgraded" to a higher level of security. The end user, by being able to change the lock cylinder, is able to change the security level of the padlock by using a higher security lock cylinder. Also, with current padlocks in which the lock cylinder is incorporated into the padlock if a key is lost or stolen, the end user must replace the padlock, which can be expensive, or take the padlock to the manufacturer or a locksmith to rekey the padlock, which is inconvenient and also possibly expensive.

Currently there are padlocks with changeable lock cylinders available; however, these changeable lock cylinders are not standard and fit only into the particular padlock for which they are designed. Other prior art locks use inserts, sleeves or other devices that must change as the lock cylinder changes. It is therefore an objective of the present invention to provide a padlock that enables any manufacturer's standard size ⅞ inch cam lock cylinder to be used with the lock. The challenge with this is that not all standard cam lock cylinders have the same length. It is therefore another objective of the present invention to provide a padlock that can adjust for the differences in length of standard cam lock cylinders.

In view of the foregoing, there is a need for improved techniques for providing a padlock body with a changeable lock cylinder that uses standard cam lock cylinders and can accommodate cam lock cylinders of different lengths.

BRIEF DESCRIPTION OF THE DRAWINGS

The present invention is illustrated by way of example, and not by way of limitation, in the figures of the accompanying drawings and in which like reference numerals refer to similar elements and in which:

FIG. 1 is a cross sectional view of the padlock in a locked position.

FIG. 2 is a cross sectional view of the padlock in an unlocked position.

FIG. 3 is an exploded view of the padlock and all of its components.

FIG. 4 is a bottom perspective view of the padlock with the cam lock cylinder installed, and FIG. 5 is a side perspective view of the padlock in the locked position.

Figure 1:
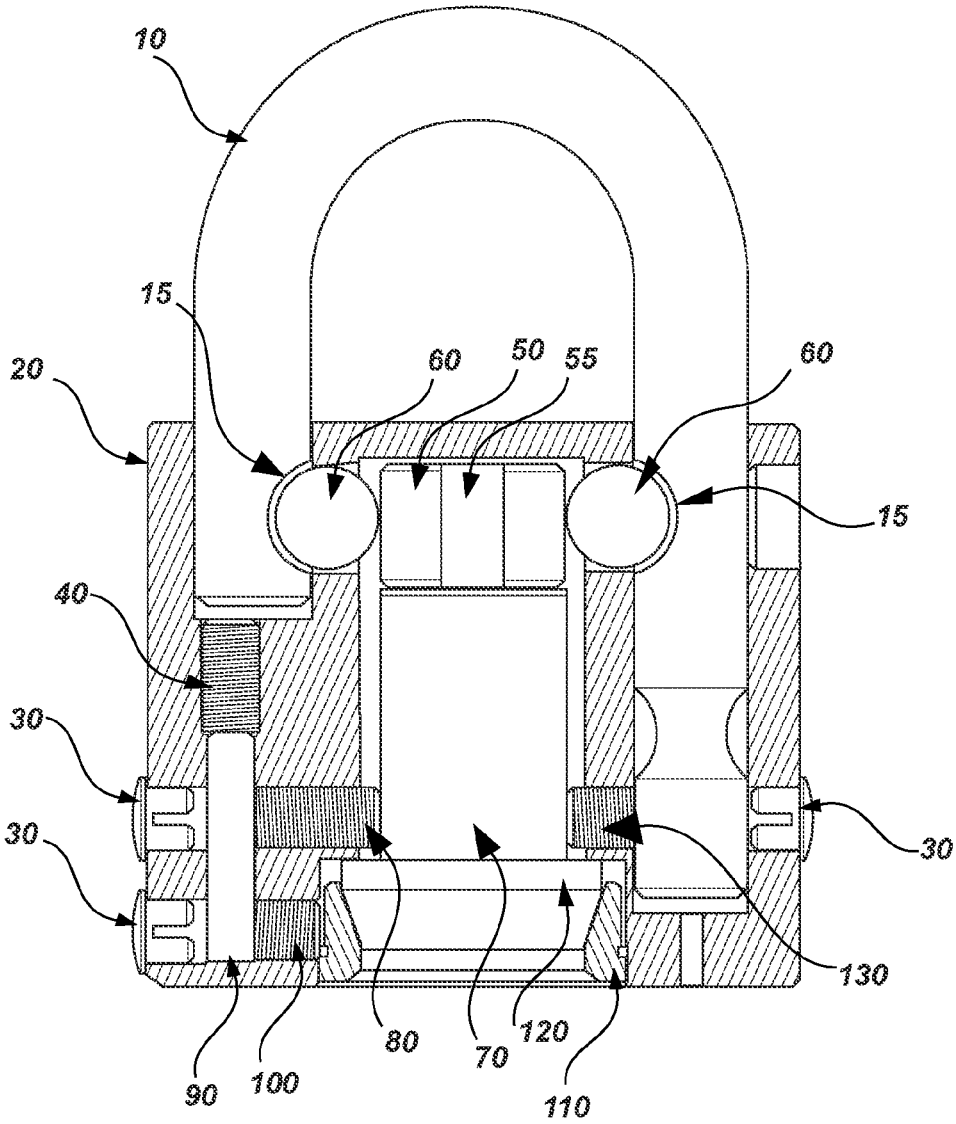
FIGS. 1 through 5 illustrate an exemplary padlock with a changeable cam lock cylinder, in accordance with an embodiment of the present invention.

Unless otherwise indicated illustrations in the figures are not necessarily drawn to scale.

DETAILED DESCRIPTION OF THE PREFERRED EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The present invention will now be described in detail with reference to embodiments thereof as illustrated in the accompanying drawings.

Detailed descriptions of the preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

Preferred embodiments of the present invention provide a padlock that enables the end user to change the padlock lock cylinder easily. This is accomplished in preferred embodiments by providing a padlock body with an adaptable cam that is independent from the lock cylinder and enables any ⅞ inch, standard cam lock cylinder to be used in the lock. In preferred embodiments, the adaptable cam can be attached to any cam lock cylinder despite the differences in standard cam lock sizes commercially on the market or cam locks that may come out in the future. Using preferred embodiments, a user has the ability to change the cam lock cylinder without any skilled knowledge or ability. Preferred embodiments provide a padlock body that is strong and secure even without a specific lock core. Preferred embodiments also enable the security of the padlock to change as the lock cylinder changes.

Figure 2:
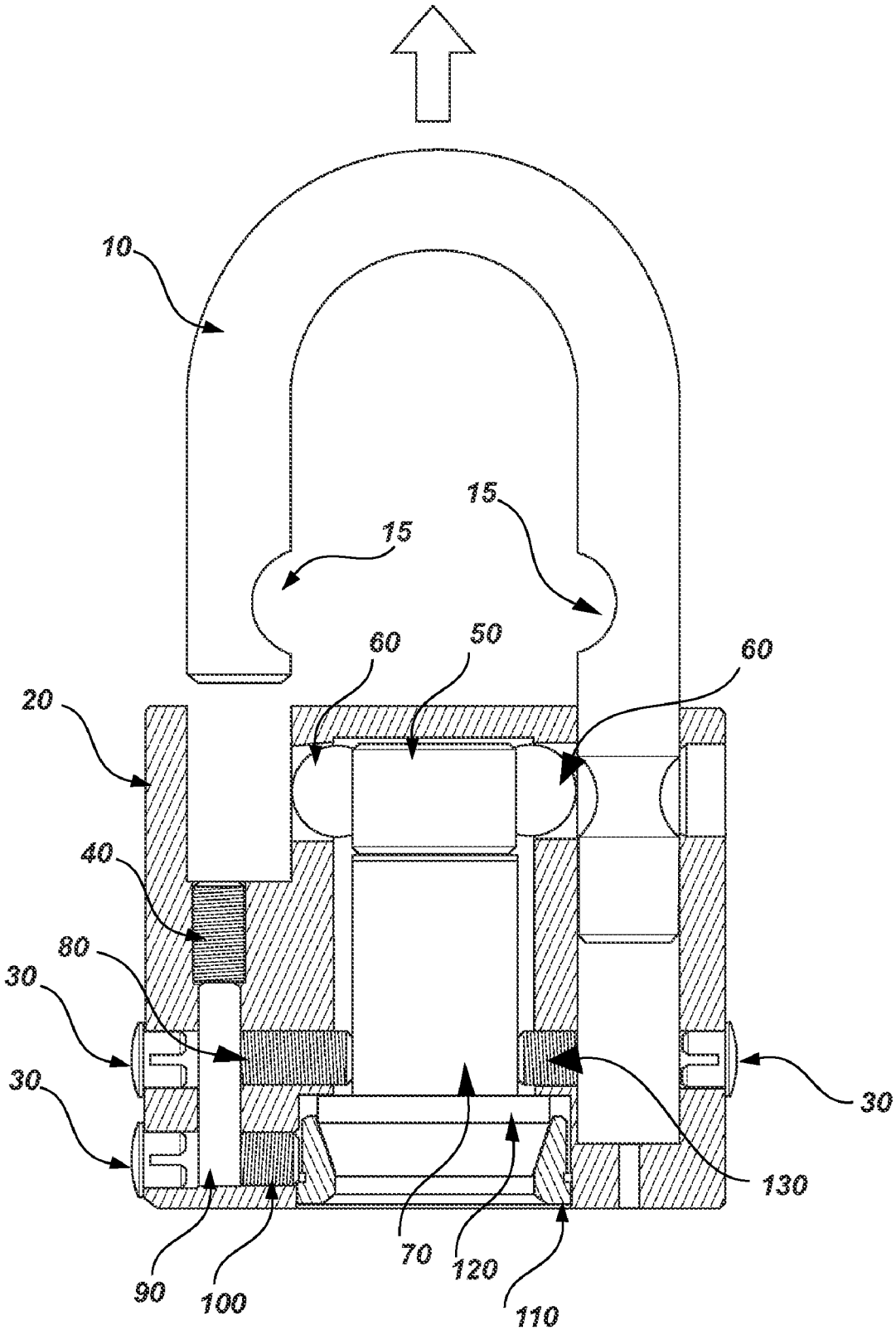
Figure 3:
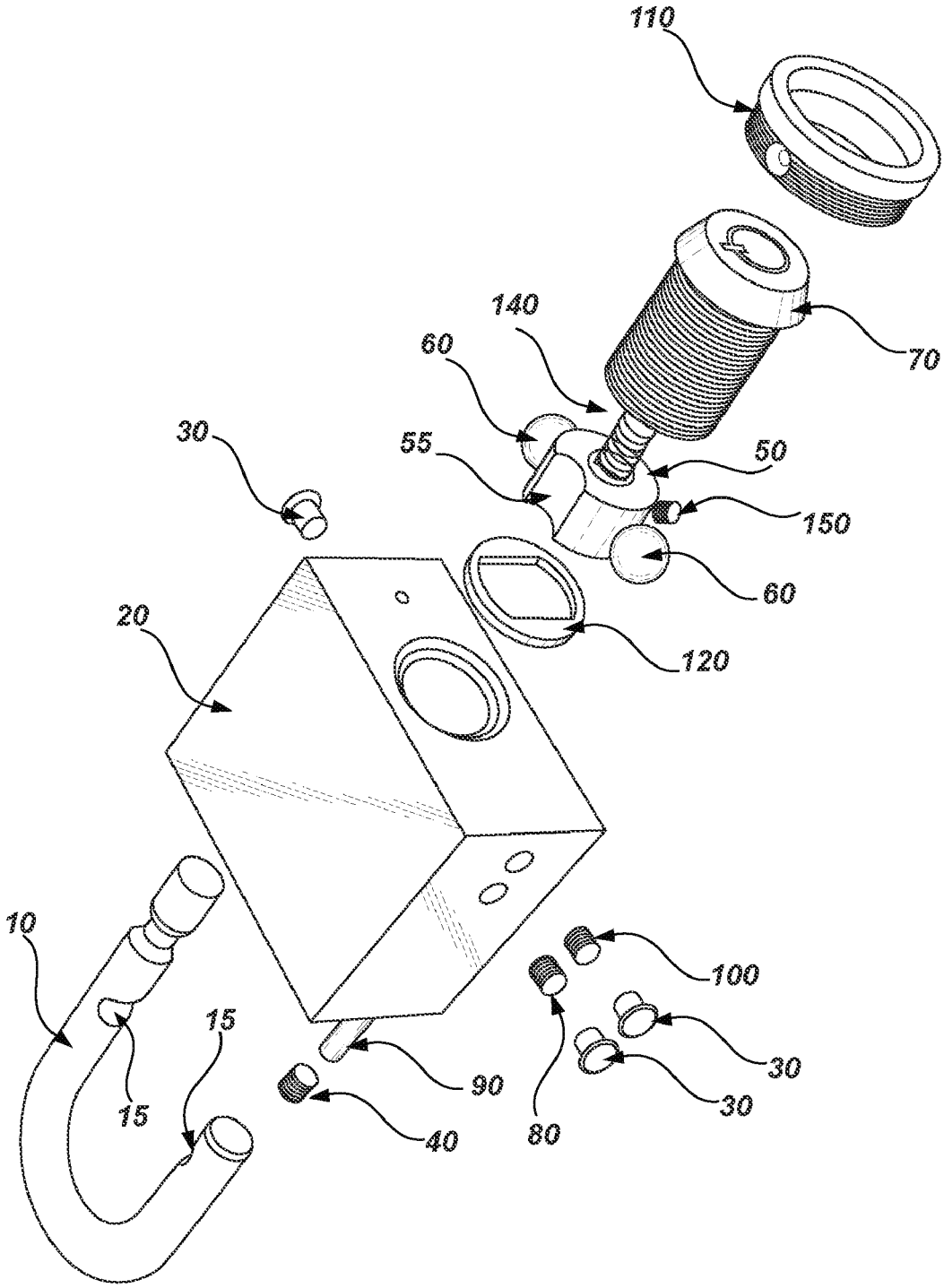
Figure 4:
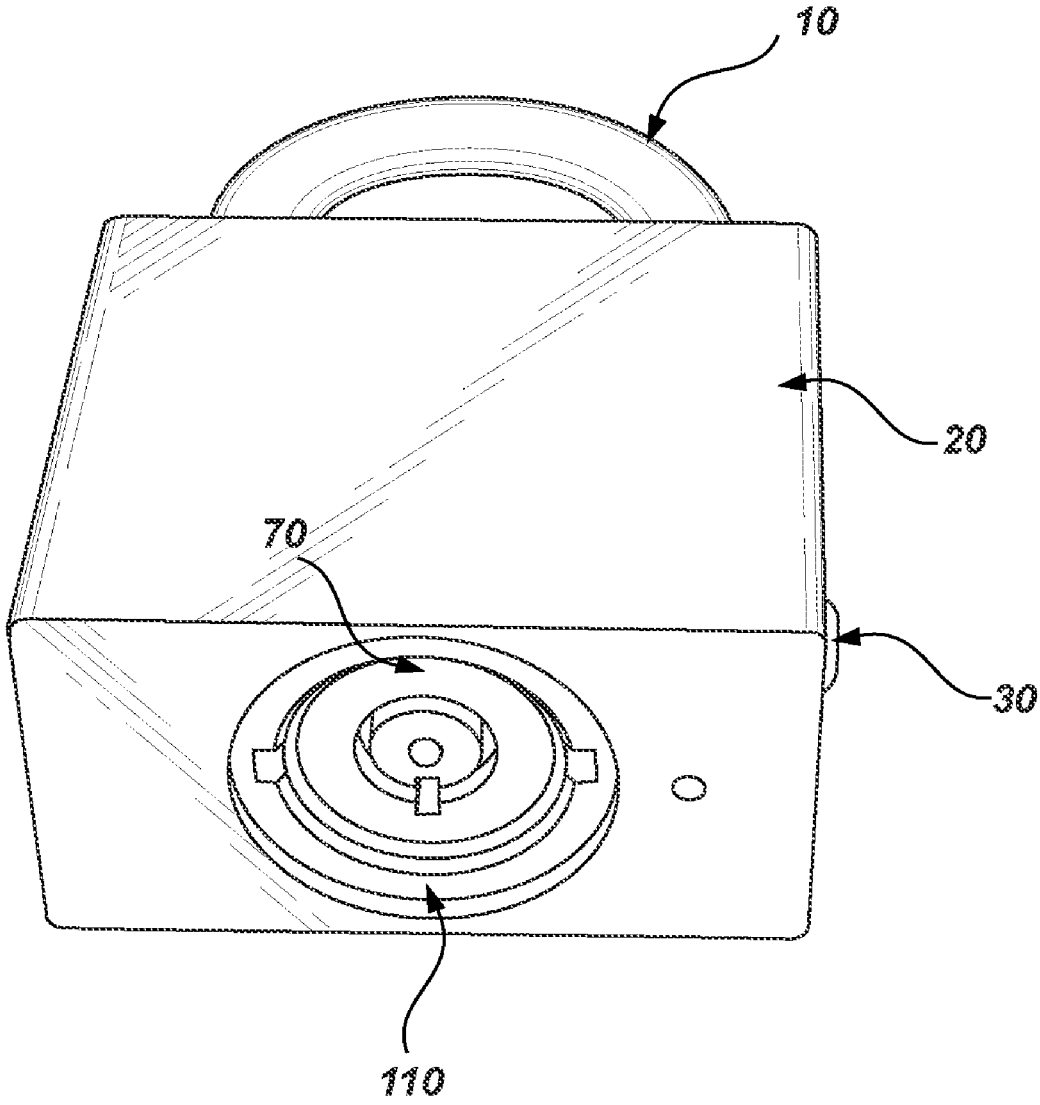
Figure 5:
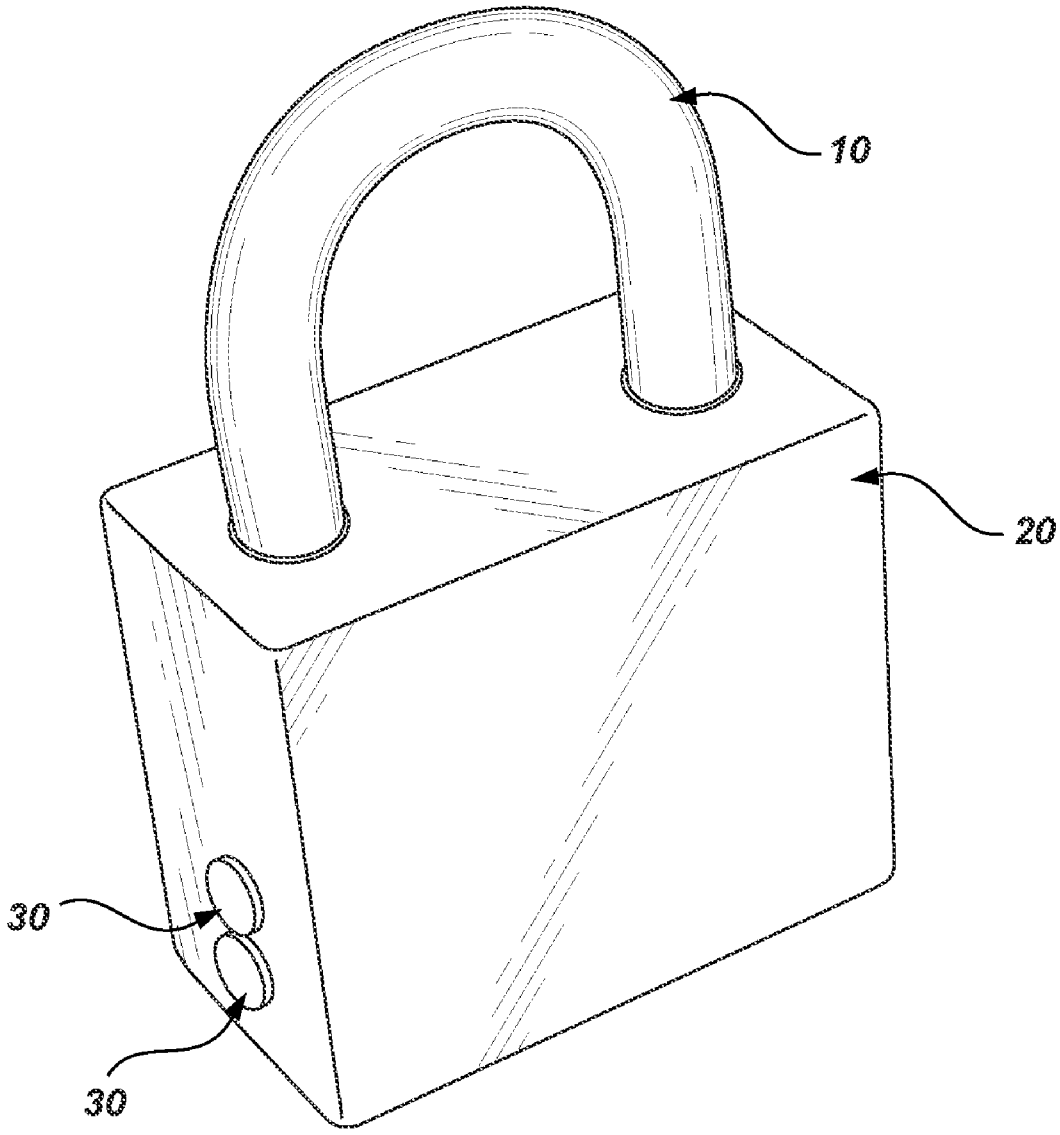

FIGS. 1 through 5 illustrate an exemplary padlock with a changeable cam lock cylinder 70, in accordance with an embodiment of the present invention. FIG. 1 is a cross sectional view of the padlock in a locked position. FIG. 2 is a cross sectional view of the padlock in an unlocked position. FIG. 3 is an exploded view of the padlock and all of its components. FIG. 4 is a bottom perspective view of the padlock with cam lock cylinder 70 installed, and FIG. 5 is a side perspective view of the padlock in the locked position. In the present embodiment, the padlock comprises a shackle 10, a padlock body 20 and cam lock cylinder 70, similar to currently known padlocks. However, cam lock cylinder 70 is interchangeable. An adaptable cam 50 is designed to fit virtually any standard, ⅞ inch cam lock. All ⅞ inch cam locks are not the same size in length even though they are advertised as ⅞ inch cam locks, and the length of adaptable cam 50 can make up the difference in the sizes of various cam locks. Adaptable cam 50 is affixed to the rear of cam lock cylinder 70 and held in place with a setscrew, roll pin or other attachment means. Adaptable cam 50 is adjustably joined to a screw shaft or tenon 140 as shown by way of example in FIG. 3, that is common to all standard cam locks. The adaptable cam is designed to fit over this screw shaft and slide easily up or down. Once the proper position is located, depending on the length of the cam lock 70, then the adaptable cam 50 is locked into position by set screw 150. In alternate embodiments other means may be used to lock in position, such as, but not limited to multiple set screws 150 or, a roll pin, etc. In the present invention, the padlock is capable of accepting a conventional longest style ⅞" cam lock. One of ordinary skill in the art will recognize that if longer cam locks are made available, only minor dimensions of the padlock need to be changed. In the present invention, the adaptable cam 50 need not reach the top of the central bore of the padlock, when using the shortest cam lock, it only needs to sufficiently engage the locking balls 60. In various alternate embodiments, more than one size adaptable cams may be provided. Locking balls 60 are put into padlock body 20 and positioned to either side of adaptable cam 50, and shackle 10 is inserted into padlock body 20.

In the present embodiment, the padlock is locked with a double ball locking mechanism; however, different locking mechanisms may be used in alternate embodiments including, but not limited to, rotating disks on the adaptable cam that fit into notches in the shackle, lever tumblers, ratchet notches, single ball locking, pin locking, etc. The double ball locking in the present embodiment is accomplished with adaptable cam 50 and locking balls 60. Adaptable cam 50 is installed on cam lock cylinder 70 and comprises a groove 55 cut into each side. Locking balls 60 rotate into and out of grooves 55 as cam lock cylinder 70 is unlocked or locked. Referring to FIG. 1, in the locked position, locking balls 60 are not in grooves 55 and are instead on the high portion of adaptable cam 50. This forces locking balls 60 into cutouts 15 of shackle 10. This action generally prevents shackle 10 from being pulled upward and open. Referring to FIG. 2, the padlock is in the unlocked position. As the correct key opens cam lock cylinder 70, it rotates adaptable cam 50 so that locking balls 60 fall into grooves 55 of adaptable cam 50. This enables locking balls 60 to move out of the way when shackle 10 is pulled up and open. In the unlocked position cam lock cylinder 70 can be removed. To install or remove cam lock cylinder 70, setscrew 40 and roll bar 90 are removed. Setscrew 100 is then removed and lock cap 110 is unscrewed from padlock body 20. Setscrew 80 and setscrew 130 are then removed and cam lock cylinder 70 and adaptable cam 50 can be removed. Then adaptable cam 50 may be removed from the end of cam lock cylinder 70 and attached to another standard ⅞ inch cam lock to be installed in padlock body 20.

When installed in the present embodiment, cam lock cylinder 70 is held in place with securing means comprising setscrews 80 and 130 and a retaining means comprising lock cap 110. Lock cap 110 is a threaded cap that is screwed into padlock body 20 and adjusted with a lock spacer 120 to its proper position. Referring to FIG. 4, when cam lock cylinder 70 is inserted into padlock body 20 and held in position with lock cap 110, the bottom of cam lock cylinder 70 maintains a flush position along the bottom of padlock body 20. Lock spacer 120 also helps make up size differences in different cam lock cylinders that may be inserted into padlock body 20. In the present embodiment, the padlock accepts the longest size standard ⅞" cam lock, to make sure that the adaptable cam aligns properly with the locking balls when inserted onto a cam lock and inserted into the lock body. The lock spacer 120 provides a means for further adjusting for a difference between the depth of the central bore and the length of the cam lock and may be used or not used depending on the length of the cam lock. In an non-limiting example, for the longest model cam lock available today lock spacer 120 may not be used, this would allow for the proper positioning of the adaptable cam when assembled into the lock and still maintain a flush position as shown in FIG. 4. Lock cap 110 is designed with holes along its circumference. To generally ensure that lock cap 110 cannot be unscrewed from padlock body 20, lock cap 110 is held in place with a setscrew 100. In one embodiment of the present invention, holes are drilled in the 12-3-6-9 o'clock positions along the circumference of the lock cap 110. This enables setscrew 100 to screw into one of these holes and maintain the flush position, as shown in FIG. 4. It also allows for a tight fit of the lock cap 110 against the cam lock 70 when the padlock is fully assembled. Alternate embodiments may be implemented without a lock cap in which the lock cylinder is held in place by the setscrews only. In the present embodiment, all setscrews 80, 100 and 130 are protected from drilling attacks. Setscrews 80 and 100 are protected with a hardened steel roll bar 90 that is held in place by a setscrew 40, which is protected by shackle 10 when in the locked position. Roll pin 90 is designed to resist drill attacks by spinning freely when drilled. In an alternate embodiment, setscrews 80 and 100 may also be protected by using a shackle that is equal in length on both sides, by using a steel plate instead of a roll pin. Setscrew 130 is protected by padlock shackle 10 when in the locked position. In the present embodiment, caps 30 cover the holes for the setscrews for appearance purposes, and may not be included in alternate embodiments.

In the present embodiment, the components of the lock are all preferably made of a strong metal or alloy such as, but not limited to, steel, iron, brass, etc. However, in alternate embodiments, some components such as, but not limited to, the lock spacer may be made of various other types of materials such as, but not limited to, plastic or rubber. Also, the padlock body illustrated in the present embodiment is generally square in shape. However, the lock bodies in alternate embodiments may be various different shapes such as, but not limited to, circles, rectangles, decorative shapes, etc. Furthermore, alternate embodiments may be implemented that use locks other than standard cam locks as the lock cylinders such as, but not limited to, other types of cylinder locks, vending locks, etc.

Having fully described at least one embodiment of the present invention, other equivalent or alternative methods of providing a padlock with interchangeable lock cylinders according to the present invention will be apparent to those skilled in the art. The invention has been described above by way of illustration, and the specific embodiments disclosed are not intended to limit the invention to the particular forms disclosed. For example, the particular implementation of the padlock body may vary depending upon the particular type of lock cylinder used. The lock cylinders described in the foregoing were directed to implementations using standard ⅞ inch cam locks; however, similar techniques are to use cam locks of various different standard sizes such as, but not limited to, ⅜ inch, ⅝ inch, 1 and ⅛ inch, etc. Implementations of the present invention that use standard cam locks of different sizes are contemplated as within the scope of the present invention. The invention is thus to cover all modifications, equivalents, and alternatives falling within the spirit and scope of the following claims.

Claim elements and steps herein have been numbered and/or lettered solely as an aid in readability and understanding. As such, the numbering and lettering in itself is not intended to and should not be taken to indicate the ordering of elements and/or steps in the claims.

What is claimed is:

1. A padlock for adjusting to a varying length of a lock cylinder, the padlock comprising:

a padlock housing;

a shackle having an unlocked position and a locked position within said padlock housing;

means for accepting the lock cylinder within a depth of said padlock housing;

means for adjusting for the varying length being adjustably joinable at a plurality of positions along a length of a distal end of the lock cylinder, and for rotatable engagement of said shackle to enable said shackle to move between said locked position and said unlocked position; and means for retaining said adjusting means and the lock cylinder within said depth by contacting a beveled surface of the lock cylinder.

2. The padlock as recited in claim 1, further comprising means for securing the lock cylinder within said depth by contacting an outside surface of the lock cylinder with flat ends.

3. The padlock as recited in claim 2, further comprising means for inhibiting removal of said securing means.

4. The padlock as recited in claim 1, further comprising means for engaging said retaining means to prevent said retaining means from being removed.

5. The padlock as recited in claim 1, further comprising means insertable within said central bore and surrounding a portion of a housing of the lock cylinder for further additionally adjusting for the varying length.

6. A padlock for adjusting to a varying length of a lock cylinder, the padlock comprising:

a padlock housing;

a shackle having an unlocked position and a locked position within said padlock housing;

means for engaging said shackle to at least retain said shackle in said locked position;

a central bore disposed in a bottom of said padlock housing having a depth longer than the varying length of the lock cylinder for accepting the lock cylinder within said padlock housing;

an adaptable cam adjustably joinable at a plurality of positions along a length of a distal end of the lock cylinder for adjusting for the varying length, and for rotatable engagement of said engaging means to enable said shackle to move between said locked position and said unlocked position; and a lock cap joinable to an open end of said central bore and comprising a beveled surface being configured for contacting a beveled surface of the lock cylinder for retaining said adaptable cam and the lock cylinder within said central bore.

7. The padlock as recited in claim 6, further comprising a first set screw entering said central bore from a first side of said padlock housing and an opposing second set screw entering said central bore from a second side of said padlock housing for securing the lock cylinder within said central bore, said first set screw and said second set screw each comprising a flat end being configured to contact an outside surface of the lock cylinder.

8. The padlock as recited in claim 7, further comprising a roller pin being orthogonally oriented to said first set screw for inhibiting rotation of said first set screw.

9. The padlock as recited in claim 8, further comprising a third set screw entering from a top of said padlock housing for retaining said roller pin within said padlock housing.

10. The padlock as recited in claim 7, wherein said shackle in said locked position inhibits rotation of said second set screw.

11. The padlock as recited in claim 8, further comprising a fourth set screw entering said central bore from said first side for engaging said lock cap to prevent said lock cap from being removed, wherein rotation of said fourth set screw is inhibited by said roller pin.

12. The padlock as recited in claim 6, further comprising a lock spacer insertable within said central bore and surrounding a portion of a housing of the lock cylinder for further additionally adjusting for the varying length.

13. The padlock as recited in claim 6, wherein said shackle further comprises at least one groove for engagement with said engaging means.

14. The padlock as recited in claim 13, wherein said adaptable cam further comprises at least one groove for engagement with said engaging means.

15. The padlock as recited in claim 11, further comprising a plurality of caps for covering distal ends of set screws facing away from said central bore.

16. A padlock for adjusting to a varying length of a lock cylinder, the padlock comprising:

a padlock housing comprising a central bore disposed in a bottom having a depth longer than the varying length of the lock cylinder for accepting the lock cylinder, and at least two bores in a top extending about opposing sides of said central bore;

a generally u-shaped shackle disposable within said at least two bores and having an unlocked position and a locked position within said padlock housing;

means for engaging said shackle to at least retain said shackle in said locked position:

an adaptable cam adjustably joinable at a plurality of positions along a length of a tenon on a distal end of the lock cylinder for adjusting for the varying length by joining at a one of said positions, and for rotatable engagement of said engaging means to enable said shackle to move between said locked position and said unlocked position;

a first set screw entering said central bore from a first side of said padlock housing;

a second set screw, opposing said first set screw, entering said central bore from a second side of said padlock housing, wherein said first set screw and said second set screw each comprise a flat end being configured to contact an outside surface of the lock cylinder and are operable for securing the lock cylinder within said central bore, and wherein said shackle in said locked position inhibits rotation of said second set screw;

a roller pin being orthogonally oriented to said first set screw and parallel to said central bore for inhibiting rotation of said first set screw;

a third set screw entering from a one of said at least two bore holes for retaining said roller pin within said padlock housing;

a lock cap joinable to an open end of said central bore and comprising a beveled surface being configured for contacting a beveled surface of the lock cylinder for retaining said adaptable cam and the lock cylinder within said central bore; and a fourth set screw entering said central bore from said first side for engaging said lock cap to prevent said lock cap from being removed, wherein rotation of said fourth set screw is inhibited by said roller pin.

17. The padlock as recited in claim 16, further comprising a lock spacer insertable within said central bore and surrounding a portion of a housing of the lock cylinder for further additionally adjusting for the varying length.

18. The padlock as recited in claim 16, wherein said shackle further comprises at least one groove for engagement with said engaging means.

19. The padlock as recited in claim 18, wherein said adaptable cam further comprises at least one groove for engagement with said engaging means.

20. The padlock as recited in claim 16, further comprising a plurality of caps for covering distal ends of set screws facing away from said central bore.

* * * * *